United States Patent [19]

Goodman et al.

[11] Patent Number: 4,464,003

[45] Date of Patent: Aug. 7, 1984

[54] INSULATION DISPLACING CONNECTOR WITH PROGRAMMABLE GROUND BUSSING FEATURE

[75] Inventors: Joseph R. Goodman, Lake City; John A. Woratyla, Camp Hill; Dale R. Zell, Elizabethtown, all of Pa.

[73] Assignee: AMP Incorporated, Harrisburg, Pa.

[21] Appl. No.: 437,998

[22] Filed: Nov. 1, 1982

[51] Int. Cl.[3] ..... H01R 13/39

[52] U.S. Cl. ..... 339/99 R; 339/14 R

[58] Field of Search ..... 339/14, 18, 19, 97 R, 339/97 P, 98, 99 R

[56] References Cited

U.S. PATENT DOCUMENTS

| | | | |
|---|---|---|---|
| 3,270,251 | 8/1966 | Evans . | |
| 3,399,374 | 8/1968 | Pauza et al. . | |
| 3,548,367 | 12/1970 | Bruetsch . | |
| 3,562,697 | 2/1971 | Gillespie . | |
| 3,732,522 | 5/1973 | Hartwell et al. . | |
| 4,027,941 | 6/1977 | Narozny | 339/98 |
| 4,073,560 | 2/1978 | Anhalt et al. | 339/99 R |
| 4,243,288 | 1/1981 | Lucius et al. . | |
| 4,327,956 | 5/1982 | Sitzler . | |

*Primary Examiner*—Joseph H. McGlynn
*Attorney, Agent, or Firm*—Russell J. Egan

[57] ABSTRACT

An electrical connector, having a programmable ground feature, is formed by a housing having a mating face, a bussing surface and a plurality of terminal passages extending between the face and the surface. A like plurality of terminals is provided, each mounted in a respective passage, and having a mating portion directed toward the mating face, an intermediate conductor engaging portion, and a detachable buss engaging portion lying on the bussing surface. A conductive buss bar engages the buss portions lying on the buss surface to selectively common the respective terminals. A further module carrying commoned terminals can be mated with the connector to provide a high density, programmable grounding connector.

11 Claims, 8 Drawing Figures

INSULATION DISPLACING CONNECTOR WITH PROGRAMMABLE GROUND BUSSING FEATURE

The present invention pertains to a mass terminatable connector, and in particular, to one in which the terminals are so formed that they can be readily programmed for commoning.

The known electrical connectors that are capable of bussing multiple terminals together generally fall into two categories, as best represented by U.S. Pat. Nos. 3,548,367; 3,732,522; or 3,562,697. The first two patents show connectors in which the terminals are originally integrally formed in strip fashion and are maintained in that configuration when they are inserted into an electrical connector. This type of arrangement does not readily lend itself to programming the connector. Rather the connector must be pre-programmed and a particular terminal configuration formed to satisfy that program. The second type utilizes a plurality of spring elements which are used to interconnect adjacent terminals. This arrangement is satisfactory if there is only a limited amount of bussing that is necessary but becomes quite cumbersome and costly when applied to a connector having a high terminal count and/or situations where the bussing is to be between non-adjacent terminals.

The present invention overcomes the difficulties of the prior art by providing an electrical connector which has the capability and economy of being mass terminatable as well as the capability of being selectively programmable to common any of the contacts carried thereby. The subject connector has an inner housing defining a plurality of terminal passages extending between a forwardly directed mating face and a rearwardly directed bussing surface. Each passage has a channel-shaped portion opening outwardly towards the rear bussing surface portion. An outer housing receives the inner housing therein and includes thereon latching, mounting, and other conventional features associated with electrical connectors. A plurality of terminals are provided, each mounted in a respective passage of the inner housing. Each terminal has a mating portion directed towards said mating face, an intermediate insulation displacing conductor engaging portion lying in the channel-shaped portion and capable of receiving a conductor therein in a mass termination fashion, and a bussing portion extending at an angle to the axis of the terminal to lie on the bussing surface. The connector further includes a conductive bussing strip which can be applied to the bussing surface and selectively interconnect the bussing portions of the respective terminals.

The present invention will be described by way of non-limiting example with reference to the drawings in which.

Figure 1:
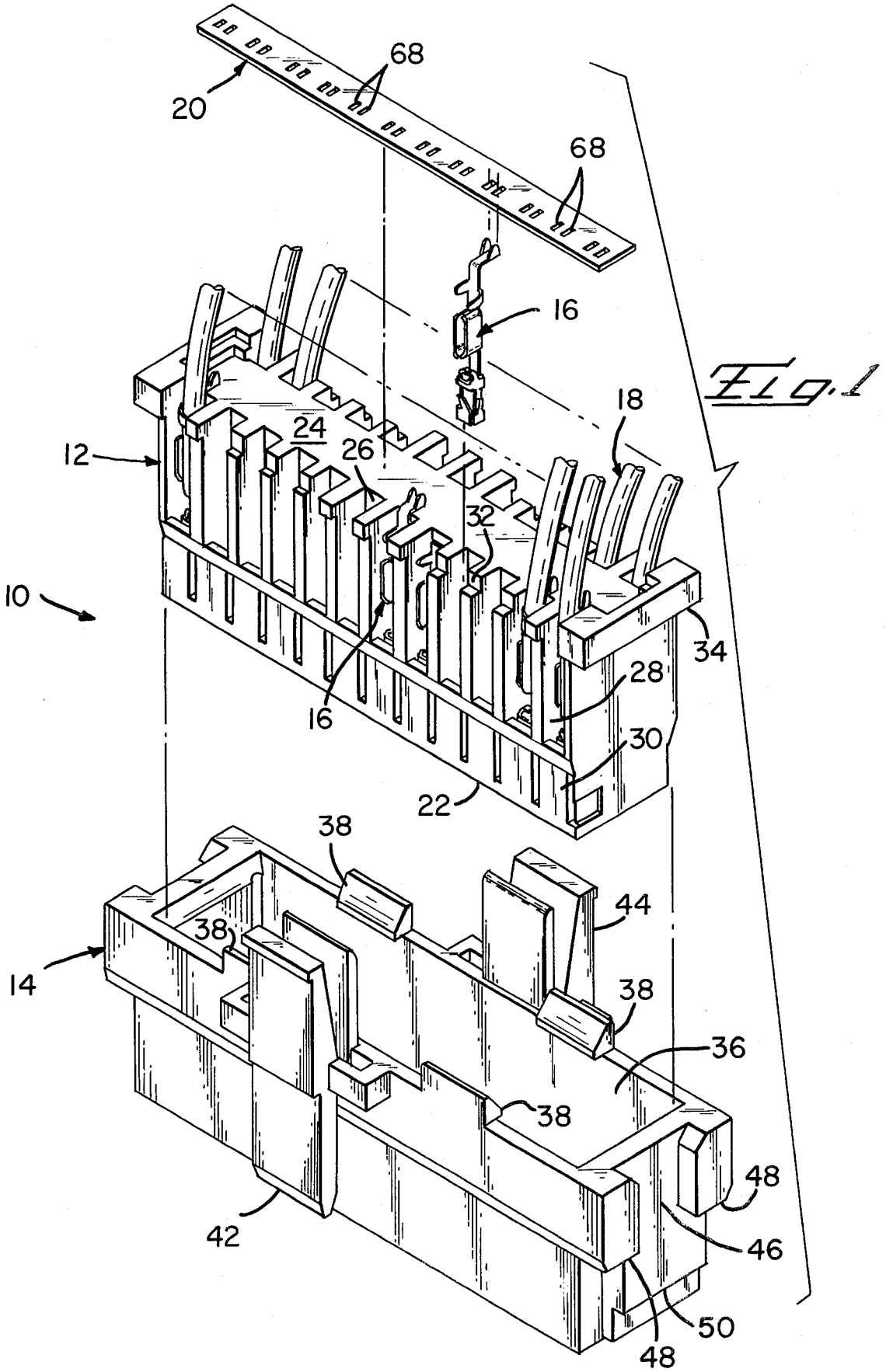
FIG. 1 is an exploded perspective view of the present invention.

The subject programmable ground electrical connector 10 comprises an inner housing 12, an outer housing 14, a plurality of terminals 16, each terminating a respective conductor 18, and a programmable bus bar 20.

The inner housing 12 is an elongated member of rigid insulative material having a forwardly directed mating face 22, a rearwardly directed bussing surface 24, and a plurality of terminal passages 26 extending between the mating face 22 and bussing surface 24. Each passage has an outwardly directed channel shape rear portion 28 and enclosed forward portion 30. The inner housing 12 also includes rearwardly directed lug engaging steps 32 and outwardly directed, lateral end flanges 34.

The outer housing 14 is also an elongated member of rigid insulative material and defines a central cavity 36 profiled to receive the inner housing 12 therein. The outer housing 14 also includes latching lugs 38 which extend over the sides to the cavity 36 to engage the steps 32 of the inner housing 12. The end surfaces 40 receive the end flanges 34 to position the inner housing 12 within the cavity 36. The elongated sides of the outer housing are shown with latching means 42, 44 of known configuration to secure the connector to associated connector or equipment (not shown). The ends of the outer housing 14 are profiled to have a central channel 46 and side lugs 48 and shoulder 50, for purposes which will be described later.

Figure 4:
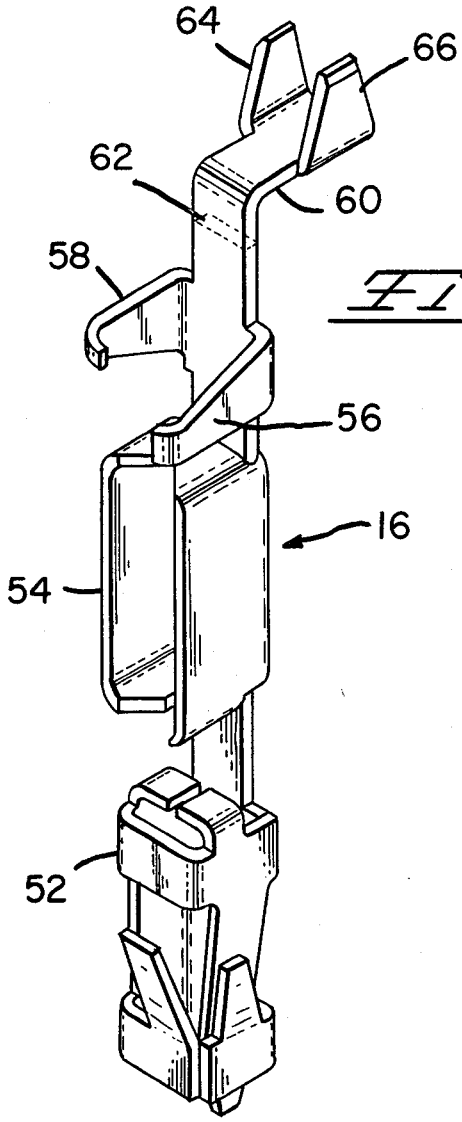
FIG. 4 is a perspective view of a single terminal according to the present invention.

The terminal 16, which is best seen in FIG. 4, has a forwardly directed mating portion 52 here shown as a receptacle of the type disclosed in U.S. Pat. No. 3,270,251, the disclosure of which is incorporated herein by reference. The terminal 16 further includes an insulation piercing conductor engaging channel 54 of the type described in U.S. Pat. No. 4,243,288, the disclosure of which is incorporated herein by reference. The terminal 16 also includes a pair of crimp ears 56, 58 and a buss portion 60 extending at an angle to the axis of the remainder of the terminal and connected thereto by a score line 62. The buss portion 60 has crimp ears 64, 66 extending therefrom.

The buss bar 20 is an elongated strip of conductive material having a plurality of pairs of slots 68 formed therein. The slots 68 are spaced to be aligned with the passages 26 and to receive crimp ears 64, 66.

Figure 3:
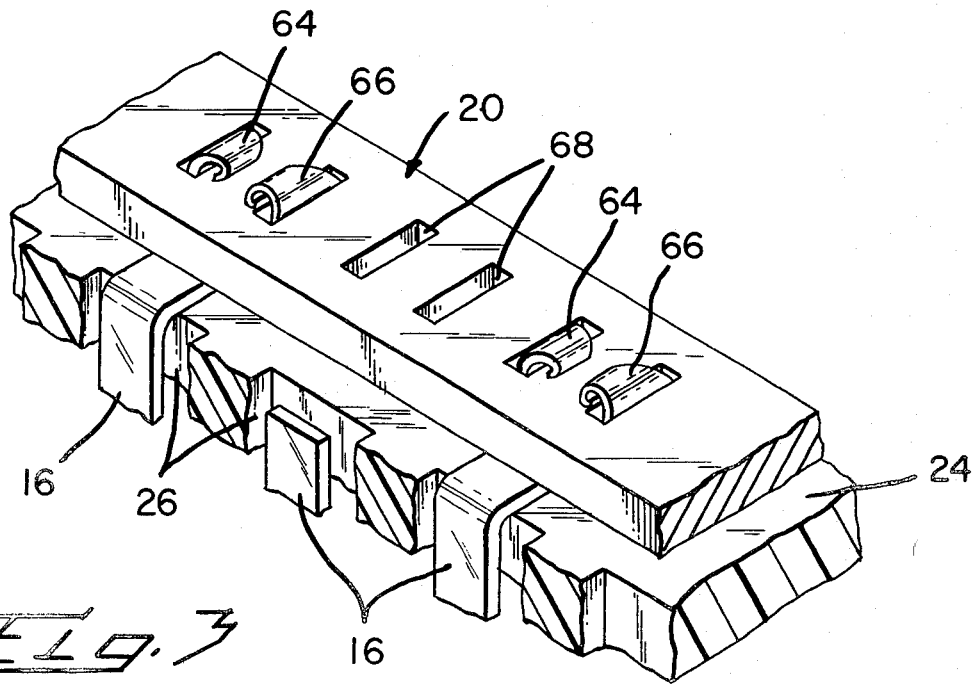
FIG. 3 is a perspective view of a detail of the bussing arrangement according to the present invention.

In this embodiment of the invention, the terminals 16 are loaded into the inner housing 12 with those terminals that are not to be bussed having their buss portions 60 broken off at the score line 62, as can be seen in FIGS. 1 and 3. The remaining terminals 16 that are to be bussed will have their buss portions 60 lying on the bussing surface 24. The terminals 16 are then terminated to their respective conductors 18 in the manner described in the previously noted U.S. Pat. No. 4,243,288. The bussing bar 20 is applied to the bussing surface 24 with the ears 64, 66 of the buss portions 60 extending through respective pairs of apertures 68 in the buss bar 20. The ears 64, 66 are crimped against the buss bar 20 as shown in FIG. 3. The assembly of the inner housing 12, terminals 16, conductors 18, and buss bar 20 is then inserted into the cavity 36 of the outer housing 14 to complete the connector 10. The flanges 34 will engage surfaces 40 to position the inner housing 12 within outer housing 14 and lugs 38 engage steps 32 to secure the housings together. The connector 10 can then be used in the standard manner of any electrical connector.

FIG. 3 shows a detail of how the ears 64, 66 are crimped to the buss bar 20 to effect a good electrical and mechanical interconnect therebetween. This Figure also clearly shows the central terminal has had the buss portion 60 removed so that it will be independent of the other two terminals which are bussed together.

Figure 2:
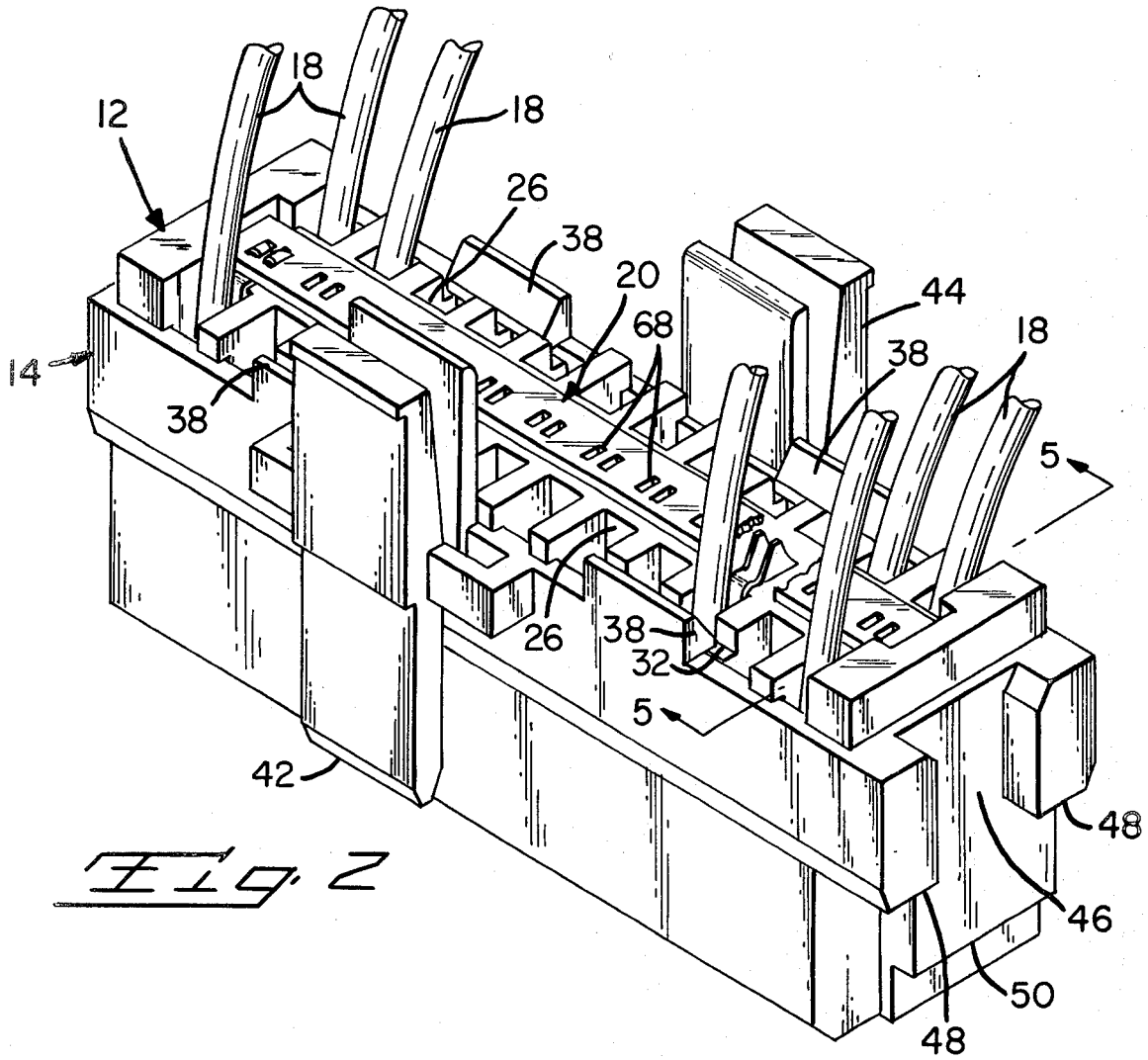
FIG. 2 is a perspective view of the fully assembled programmable ground electrical connector according to the present invention.
Figure 5:
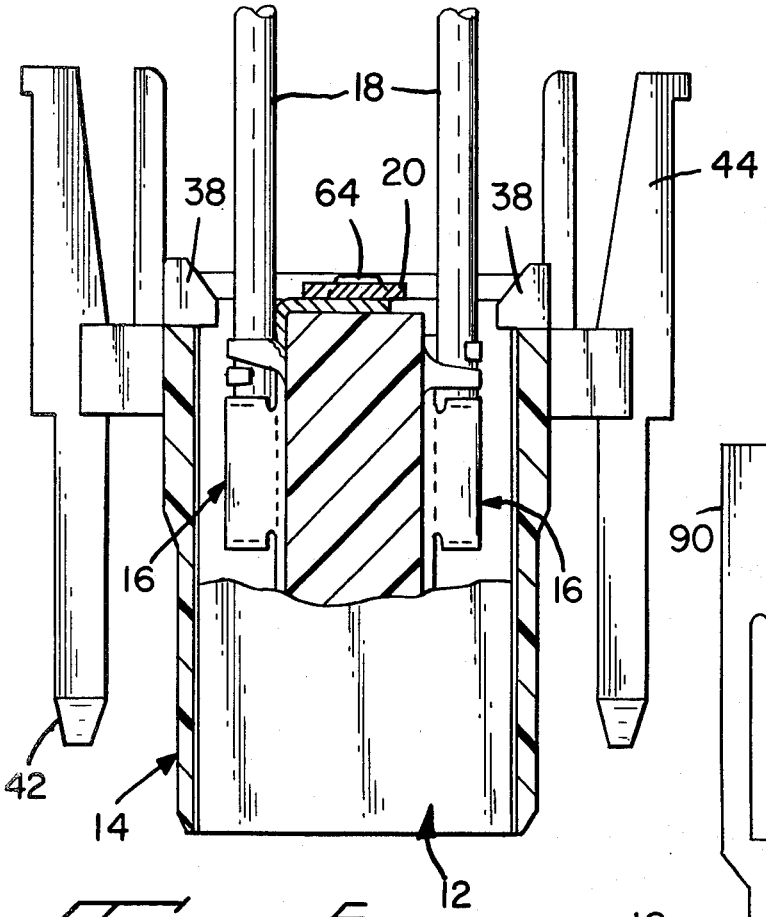
FIG. 5 is a transverse section taken along line 5—5 of FIG. 2.

FIG. 5 is a transverse section through the assembled connector of FIG. 2 showing how the buss portion 60 of a terminal 16 overlies the buss surface 24 and is engaged by the buss bar 20. The connector illustrated is a two row connector. Thus, it is possible to buss the terminals of either or both rows together. If two opposite terminals are to be bussed, then a dimensional accommodation must be made.

Figure 7:
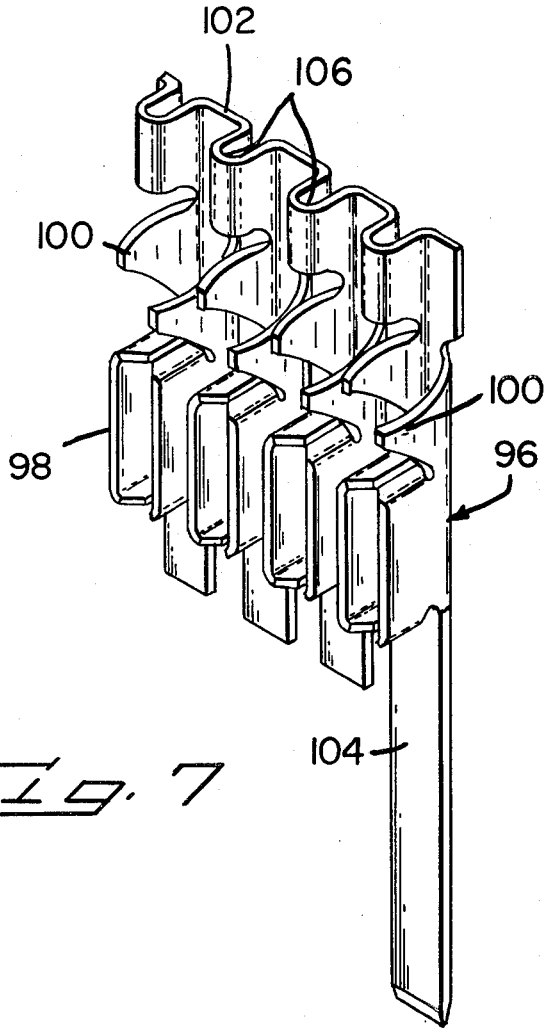
FIG. 7 is a perspective view of a terminal strip for use in the additional bussing module of the present invention shown in FIG. 6.
Figure 8:
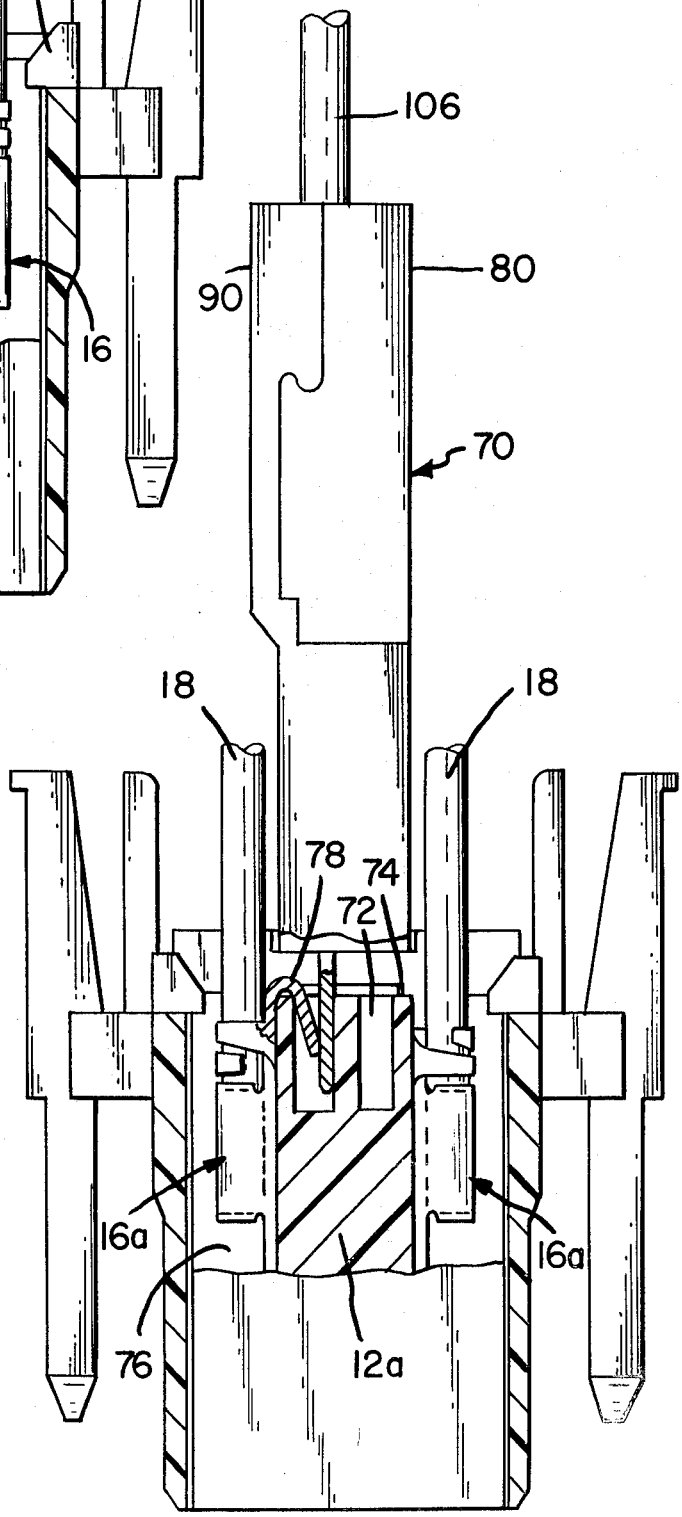
FIG. 8 is a transverse section taken along line 8—8 of FIG. 6.
Figure 6:
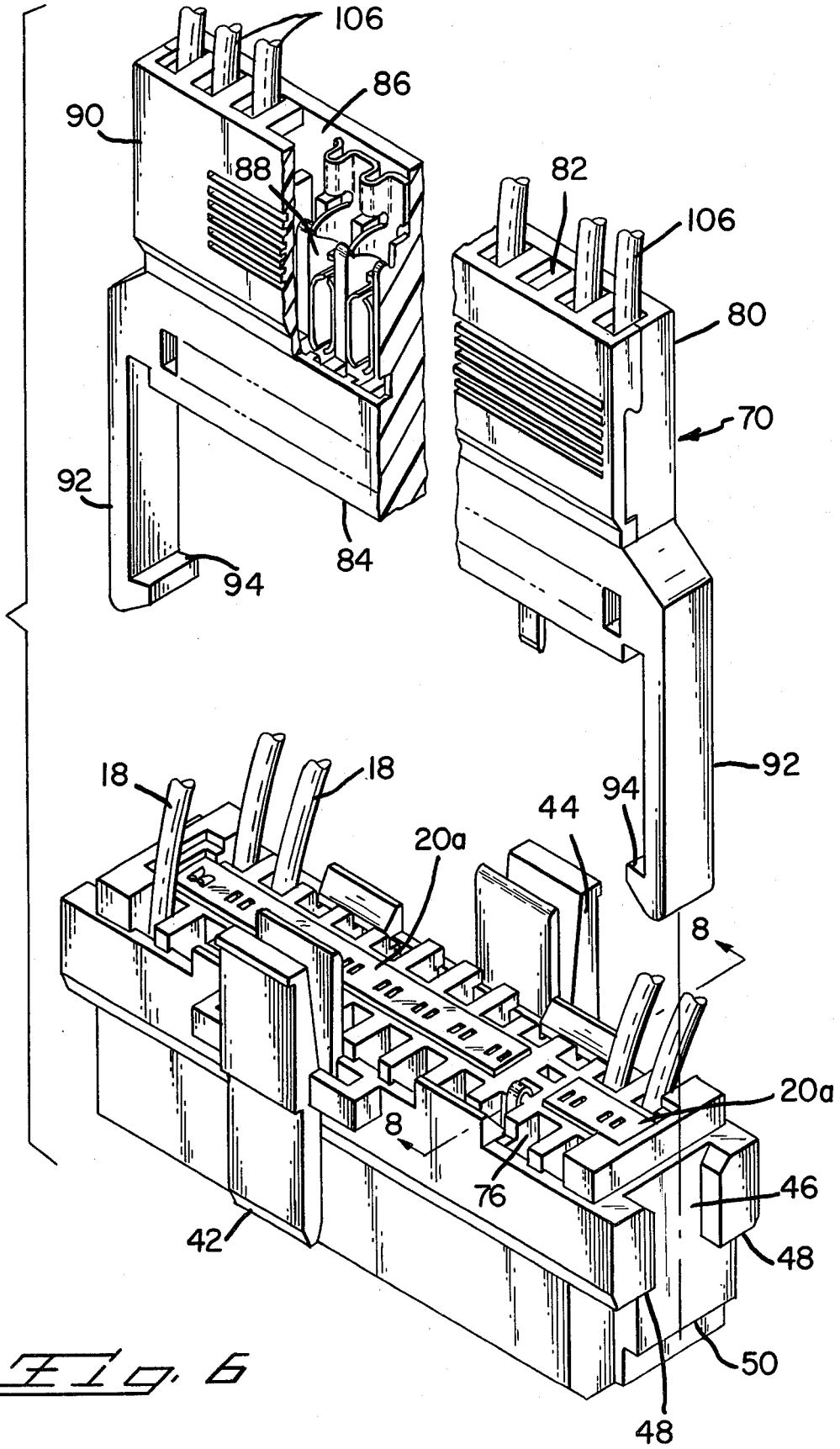
FIG. 6 is a perspective view of an alternate embodiment of the present invention using an additional bussing module.

FIGS. 6 to 8 show an alternate embodiment of the subject programmable ground connector which allows for commoning a greater number of conductors. This embodiment is quite similar to the previously described embodiment but uses an additional module 70 to achieve extra bussing. In this embodiment the inner housing 12*a* has a plurality of recesses 72 formed in the bussing face 74, each recess aligned with a respective passage 76. The terminals 16*a* are provided with an elongated tab 78 in place of the previous buss portion 60. The tab 78 is bent almost double upon itself to lie in the recess 72. The remainder of the connector is identical with the preferred embodiment except that buss bar 20*a* is sized to form gaps opposite the terminals 16*a*. The module 70 has an elongated housing 80 of insulating material defining a plurality of terminal passages 82 extending from a front mating face 84 to a rear surface 86. The rear portion 88 of each passage is channel shaped and is enclosed in a cover 90. This portion of the module is similar to the connector disclosed in the previously mentioned U.S. Pat. No. 4,243,288. The housing 80 further has, at each end, a latching arm 92 with an inwardly directed lug 94 on the free end thereof. These arms 92 are profiled to extend through channels 46 and the lugs 94 to engage shoulders 50.

The module 70 has at least one terminal strip 96 therein. The terminal strip 96, which is best seen in FIG. 7, has a plurality of insulation displacing connecting bodies 98, conductor crimp ears 100, integral carrier strip 102, and at least one blade 104 depending from a body 98. The bodies 98 and ears 100 are comparable to like parts 54 and 56, 58 of terminals 16. The carrier strip 102 is folded upon itself at 106 to draw the bodies into closer spacing to be received in passages 82. The blade 104 is positioned to extend from mating face 84 and into recess 72 in wiping engagement with tab 78.

The module 70 is assembled by preloading a terminal strip 96 therein. Conductors 106 are terminated to the respective bodies in the same manner as conductors 18. The cover 90 is applied and the module 70 is ready to mate with connector 10. The mating is simple and direct and substantially increases the number of conductors commoned in a single connector.

We claim:

1. A programmable ground electrical connector formed by a housing of rigid insulative material defining a plurality of terminal passages extending between a mating face and an oppositely directed parallel spaced bussing surface, a plurality of electrical terminals, each mounted in a respective passage with a mating portion directed towards said mating face, an intermediate insulation piercing conductor engaging portion, and a buss bar receivable on said bussing surface and adapted to electrically and mechanically engage respective terminals, characterized by a bussing portion detachably secured to each terminal and extending at an angle to the axis of said terminal to lie on said bussing surface and electrically and mechanically engage said buss bar.

2. The programmable ground electrical connector according to claim 1 characterized by said bussing portion of each said terminal being attached to the remaining terminal by a score line and including a pair of crimp ears, said buss bar being a conductive member having pairs of slots each receiving a respective crimp ear therethrough.

3. The programmable ground electrical connector according to claim 1 characterized by an additional bussing module having a housing of insulative material defining a plurality of terminal passages therein extending between a mating face and a rear surface, a terminal strip having a plurality of insulation piercing conductor engaging bodies each mounted in a respective passage, at least one blade portion depending from one of said bodies and extending beyond said mating face, and a commoning strip integral with each said body whereby said module can be applied to said connector with said at least one blade engaging like bussing portions of respective connector terminals to effect additional commoning of conductors terminated by said connector.

4. The programmable ground electrical connector according to claim 1 characterized by an outer housing having a central cavity receiving said housing therein and latching means to secure said outer housing and said housing together.

5. The programmable ground electrical connector according to claim 4 characterized by said outer housing further comprising latching means to secure said connector to a mating component.

6. An electrical connector having a programmable ground feature, said connector comprising:

a housing of rigid insulative material defining a plurality of terminal passages extending between a forwardly directed mating face and a rearwardly directed bussing surface;

a plurality of electrical terminals each mounted in a respective passage with a mating portion directed towards said mating face, an intermediate insulating piercing conductor engaging portion, and a detachable bussing portion extending at an angle to the axis of the terminal to lie on said bussing surface; and a buss bar receivable on said bussing surface and adapted to electrically and mechanically engage the bussing portion of the respective terminals.

7. The electrical connector according to claim 6 wherein said bussing portions of said terminals each comprise a pair of crimp ears with said portion being attached to the terminal by a score line, said buss bar comprising an elongated conductive member having a plurality of pairs of slots therein each spaced to receive therethrough respective ones of said pairs of crimp ears.

8. The electrical connector according to claim 6 wherein said mating portion of each said terminal is a receptacle.

9. The electrical connector according to claim 6 further comprising:

an additional bussing module having a housing of rigid insulative material defining a plurality of terminal passages therein extending between a mating face and a rear surface;

a commoning strip having a carrier strip with a plurality of insulation piercing conductor engaging bodies depending therefrom each in a respective passage of said module housing, a blade portion depending from at least one of said bodies and extending beyond said mating face whereby application of said module to said connector brings said blades into engagement with bussing portions of respective terminals to effect additional grounding.

10. The electrical connector according to claim 6 further comprising an outer housing forming a shroud around said housing and including latching means to secure said outer housing.

11. The electrical connector according to claim 10 wherein said outer housing further comprises latching means to secure said connector to a mating component.

* * * * *